US011470986B2

(12) United States Patent
Feig

(10) Patent No.: US 11,470,986 B2
(45) Date of Patent: Oct. 18, 2022

(54) ANOXIC MICROCLIMATE STORAGE AND DISPLAY DEVICE

(71) Applicant: Jerome S. Feig, Huntington Woods, MI (US)

(72) Inventor: Jerome S. Feig, Huntington Woods, MI (US)

( * ) Notice: Subject to any disclaimer, the term of this patent is extended or adjusted under 35 U.S.C. 154(b) by 378 days.

(21) Appl. No.: 16/739,565

(22) Filed: Jan. 10, 2020

(65) Prior Publication Data

US 2020/0229617 A1 Jul. 23, 2020

Related U.S. Application Data

(60) Provisional application No. 62/793,921, filed on Jan. 18, 2019.

(51) Int. Cl.
*A47F 3/00* (2006.01)
*A47G 1/06* (2006.01)

(52) U.S. Cl.
CPC ..... *A47F 3/001* (2013.01); *A47F 3/002* (2013.01); *A47G 1/0622* (2013.01)

(58) Field of Classification Search
CPC ..... A47F 3/001; A47F 3/002; A47F 3/005; A47G 1/0622; A47G 1/06; A47G 1/12; C03C 17/34; G01M 3/3272
See application file for complete search history.

(56) References Cited

U.S. PATENT DOCUMENTS 4,664,254 A * 5/1987 Sitwell ..... B65D 81/07 206/583
4,723,809 A 2/1988 Kida
4,831,754 A * 5/1989 Tallent ..... A47F 7/02 40/800
4,951,555 A * 8/1990 Hahn ..... A47F 3/001 454/238
5,125,175 A * 6/1992 Huff, Jr. ..... G09F 1/12 40/725
5,127,715 A 7/1992 Doyle
5,127,718 A 7/1992 Paine
5,238,648 A * 8/1993 Kremen ..... A47F 3/002 422/291

(Continued)

FOREIGN PATENT DOCUMENTS

WO WO-9951128 A1 * 10/1999 ..... A47F 3/005
WO 2013-095352 A1 6/2013

OTHER PUBLICATIONS

U.S. Appl. No. 14/206,761, filed Mar. 12, 2014.

*Primary Examiner* — Patrick D Hawn
(74) *Attorney, Agent, or Firm* — Blue Filament Law PLLC

(57) ABSTRACT

An enclosure is provided for displaying artwork, historical documents, or artifacts that require controlled atmospheric conditions. The enclosure is of low cost and is less cumbersome as compared to existing microclimate enclosures. The enclosure is easy to set up, maintain, and monitor. The enclosure has a microclimate hypoxic/anoxic framing that protects against, oxidation of its contents, pests, and microbial growth. The enclosure is suitable for: paintings, works on paper, ephemera, textiles, mineral specimens, archeological metallic artifacts, animal skins and other organic items, rubber and polymers, and items susceptible to insect damage, water staining and tide lines from uncontrolled internal humidity conditions.

17 Claims, 4 Drawing Sheets

(56) References Cited

U.S. PATENT DOCUMENTS 6,001,487 A * 12/1999 Ladang ..... B32B 17/10174 428/432
6,263,604 B1 * 7/2001 Williams ..... B44C 5/02 40/761
6,688,030 B2 * 2/2004 Vihos ..... B44C 5/02 206/204
6,792,710 B2 * 9/2004 Whitlow ..... A47G 1/06 40/792
7,266,920 B2 * 9/2007 Kao ..... A47G 1/12 40/781
7,281,561 B2 10/2007 Anderson
8,270,059 B2 9/2012 Friedman
9,781,847 B2 * 10/2017 Sun ..... G02F 1/1333
10,219,640 B2 * 3/2019 Feig ..... A47G 1/12
10,222,837 B1 * 3/2019 Budinich ..... G06F 1/1643
10,392,301 B2 * 8/2019 Wang ..... B32B 27/06
10,472,879 B1 * 11/2019 Galler ..... E05B 53/00
10,580,333 B2 * 3/2020 Artwohl ..... G09G 3/2096
11,161,673 B2 * 11/2021 Wines ..... A47B 47/0075
2002/0078613 A1 * 6/2002 Roberts ..... A47G 1/0622 40/718
2003/0029069 A1 2/2003 Vihos
2009/0015114 A1 1/2009 Vihos
2009/0027759 A1 1/2009 Albahri
2009/0181203 A1 * 7/2009 Valentin ..... B32B 17/10045 428/38
2011/0059275 A1 * 3/2011 Stark ..... C03C 27/08 428/34
2014/0039674 A1 2/2014 Motoyama
2014/0278178 A1 * 9/2014 Feig ..... G01M 3/3272 702/81
2015/0070928 A1 * 3/2015 Rau ..... A47F 11/10 362/604
2019/0038047 A1 * 2/2019 Chi ..... A47F 3/0408
2019/0090659 A1 * 3/2019 Fixler ..... A47F 3/001
2019/0322445 A1 * 10/2019 Farrar ..... B65D 21/0201
2020/0170422 A1 * 6/2020 Goppion ..... A47F 3/001
2020/0229617 A1 * 7/2020 Feig ..... A47G 1/102

* cited by examiner

ANOXIC MICROCLIMATE STORAGE AND DISPLAY DEVICE

RELATED APPLICATIONS

This application claims priority benefit of U.S. Provisional Application Ser. No. 62/793,921, filed Jan. 18, 2019, the contents of which are hereby incorporated by reference.

FIELD OF THE INVENTION

The present invention in general relates to display cases and in particular to enclosures for displaying artwork, historical documents, and artifacts that require controlled atmospheric and light exposure conditions.

BACKGROUND OF THE INVENTION

Hypoxic microclimate storage technology has been widely used for many years in the food industry. As a basis of preservation, inert gas is used to displace air and moisture in packaging to extend the shelf lives of package contents. Gases such as noble gases, nitrogen, and carbon dioxide tend to inhibit oxidation, hydrolysis, and other chemical reactions, which degrade the enclosed products. The conservation field has embraced this microclimate technology to the preserve historical and archeological artifacts. Exemplary artifacts contained in reduced oxygen or anoxic microclimate storage technology are the founding documents of the United States in the National Archives, Washington, D.C.; and mummies in the Egyptian Museum of Antiquities in Cairo, Egypt.

Research on the use of micro climates with anoxic or hypoxic atmospheres started in the late 1980's at the Conservation Institute at the Getty Museum in California. The Getty research centered on the use of nitrogen, argon, and other inert gases in the conservation storage and display of artifacts. The Getty Museum published a paper on the subject in entitled 1998 Oxygen-Free Museum Cases (1998, Edited by Shin Maekawa).

Microfading is an accelerated method for assessing the vulnerability of individual museum objects to light-fading, including those for which the identity of the colorant is unknown. During the microfading process a small area typically about 0.3-0.4 $mm^2$ on the surface of an object is faded to an imperceptible degree using a powerful but cold source of visible light and spectral change is tracked in real time using visible reflectance spectroscopy. The microfading process provides exposures equivalent to 5-10 years display at normal museum light levels that are achieved within a 10 minute test period and the results are routinely used to set exhibition and loan display conditions for a particular object based on its measured sensitivity to light. The microfading process is important for conservators, who are routinely asked to set "safe" display conditions for objects and yet the fading rate of even a known colorant typically varies significantly with a range of factors associated with its physical and chemical environment (e.g., mordants), origin, processing, manufacture, application, and past history. Many of these factors like mordants, prior fading, or the identity of the dye itself are either unknowable in principle, or too difficult and expensive to routinely determine.

Despite the advances in preservation technologies, enclosures for displaying precious art work and artifacts remain quite costly and cumbersome. Thus, there exists a need for low cost and less cumbersome microclimate display enclosure that is easy to set up, maintain, and monitor.

SUMMARY OF THE INVENTION

A controlled atmospheric enclosure is provided that includes a frame with an upper lip and a lower lip, a gasket, a back plate or pan, and a cover that rests under the upper lip of the frame. The back plate or pan is injection molded, thermoformed, or stamped, and is supported by the lower lip of the frame. The gasket is positioned between the cover and the back plate or pan and forms a press fit between the upper lip and lower lip that is airtight and forms a controlled atmospheric enclosed area for display of objects and artifacts.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DESCRIPTION OF THE INVENTION

Figure 1:
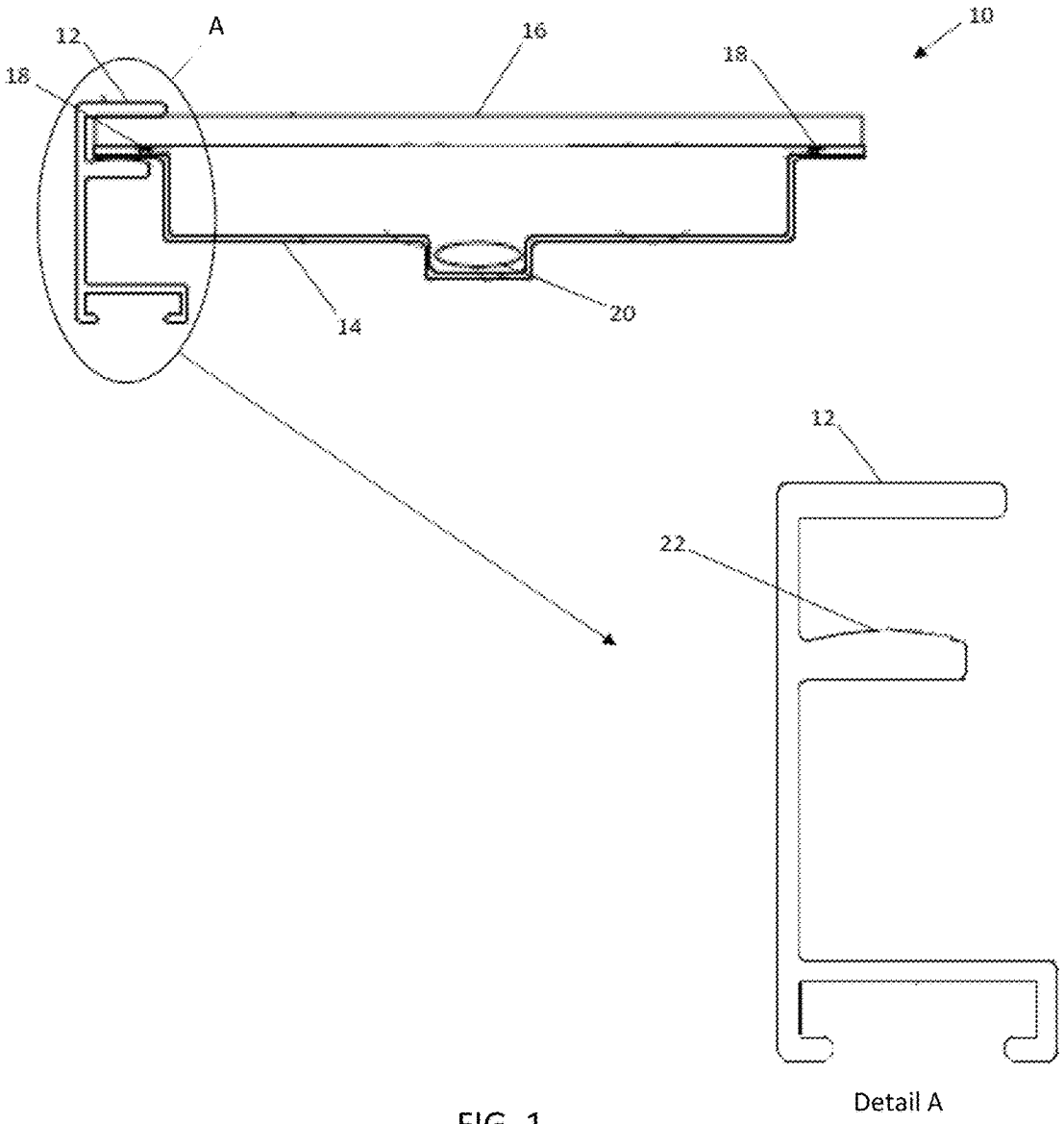
FIG. 1 is a cross-sectioned view of a microclimate hypoxic/anoxic framing enclosure with the cover and back plate secured to the frame according to embodiments of the invention.

The present invention has utility as an enclosure for displaying artwork, historical documents, or artifacts that require controlled atmospheric conditions. Embodiments of the invention provide for low cost and less cumbersome display enclosures compared to existing microclimate enclosures. Embodiments of the inventive enclosure are easy to set up, maintain, and monitor. In particular inventive embodiments, the enclosure has a microclimate hypoxic/anoxic framing enclosure that protects against, oxidation of its contents, pests, and microbial growth. Embodiments of the enclosure are suitable for: paintings, works on paper, ephemera, textiles, mineral specimens, archeological metallic artifacts, animal skins and other organic items, rubber and polymers, and items susceptible to insect damage, water staining and tide lines from uncontrolled internal humidity conditions.

In inventive embodiments of the display enclosure, a non-porous back pan may be made of low cost and lightweight materials illustratively including formed metal, coated sheet metal, ceramic, glass, optional powder painted surfaces, or multi-layer polymer with non-porous properties. In a particular inventive embodiment, an enclosure is formed of a sheet metal stamping. Alternative pans are formed by injection molding or thermoforming. Embodiments of the inventive enclosure may have a compression seal that utilizes a wedge action of the metal picture frame molding or other metal extrusion to compress the flange of the pan, gasket, and a cover that may be a glazing together for a gas-tight seal for up to twenty years before evaluation of contents. An inventive enclosure in some embodiments is configured with one or more valves that may be stainless steel metal valves—inlet and exhaust—with seals that provide a custom internal micro climate with custom gas mixtures and humidity levels that is also able to support positive pressure over ambient atmospheric pressure in the enclosure interior capable to reduce possible contamination or inward leakage of ambient air. In a specific inventive embodiment nitrogen, argon, and other inert gases are inputted into said atmospheric enclosed area via said one or more valves. Operatively nitrogen, argon and other inert gases used in the conservation storage and display of precious items may be inputted into the enclosure as specified by a qualified conservator for custom conditioning of the enclosure or for permanent storage. It is appreciated that different gas mixtures are readily employed for conditioning and storage of an article.

In specific inventive embodiments, a power/data cable may transition from an outer side surface of the frame to the atmospheric enclosed area for connection to a telemetry device and/or internal lighting.

In inventive embodiments of the enclosure, artifacts placed in the enclosure may be viewed clearly without distortion through a cover formed of a top sheet of glazing such as laminated glass water white glass—annealed or tempered, or other protective glass product such as or single strength coated glass. In some inventive embodiments, the glass further includes an anti-reflective coating with 98% or better UV filtering. In certain embodiments of the present invention, electrochromic glass may be used for variable control of light entering the enclosure. In specific inventive embodiments, the shading of the electrochromic glass may be controlled electronically via a user interface, or the shading may change automatically based on the lighting conditions incident to the cover of the enclosure.

The frame of the inventive enclosure may be configured in custom and ready-made sizes for two dimensional (2-D) or three dimensional (3-D) items, and may be surrounded with conventional picture frame moldings or other extrusion moldings. Within the enclosure area space may be provided for environmental materials for atmospheric controls illustratively including zeolites and activated carbon for contamination absorption, oxygen absorbers, silica gel (desicant-moisture absorbers), as well as test/indicator strips, data logging sensors, and an expandable bag for barometric control. In specific inventive embodiments, atmospheric control materials are kept out of the site of viewers by placing the control materials behind the protected object in a depressed compartment in the pan or back plate platform.

Referring now to the figures, FIG. 1 is a cross-sectioned view of a microclimate hypoxic/anoxic framing enclosure 10 with the cover 16 and back plate or pan 14 secured to the frame 12. A gasket 18, which may be made of rubber, is sandwiched between the flange of the back plate or pan 14 and the cover 16. The frame 12, which may be an aluminum picture frame molding, has a wedge 22 that provides a wedge action by the frame molding to compress the flange of the pan 14, gasket, and the cover 16. An absorbent sachet 20 is shown placed in a compartment of the back plate or pan 14.

Figure 2:
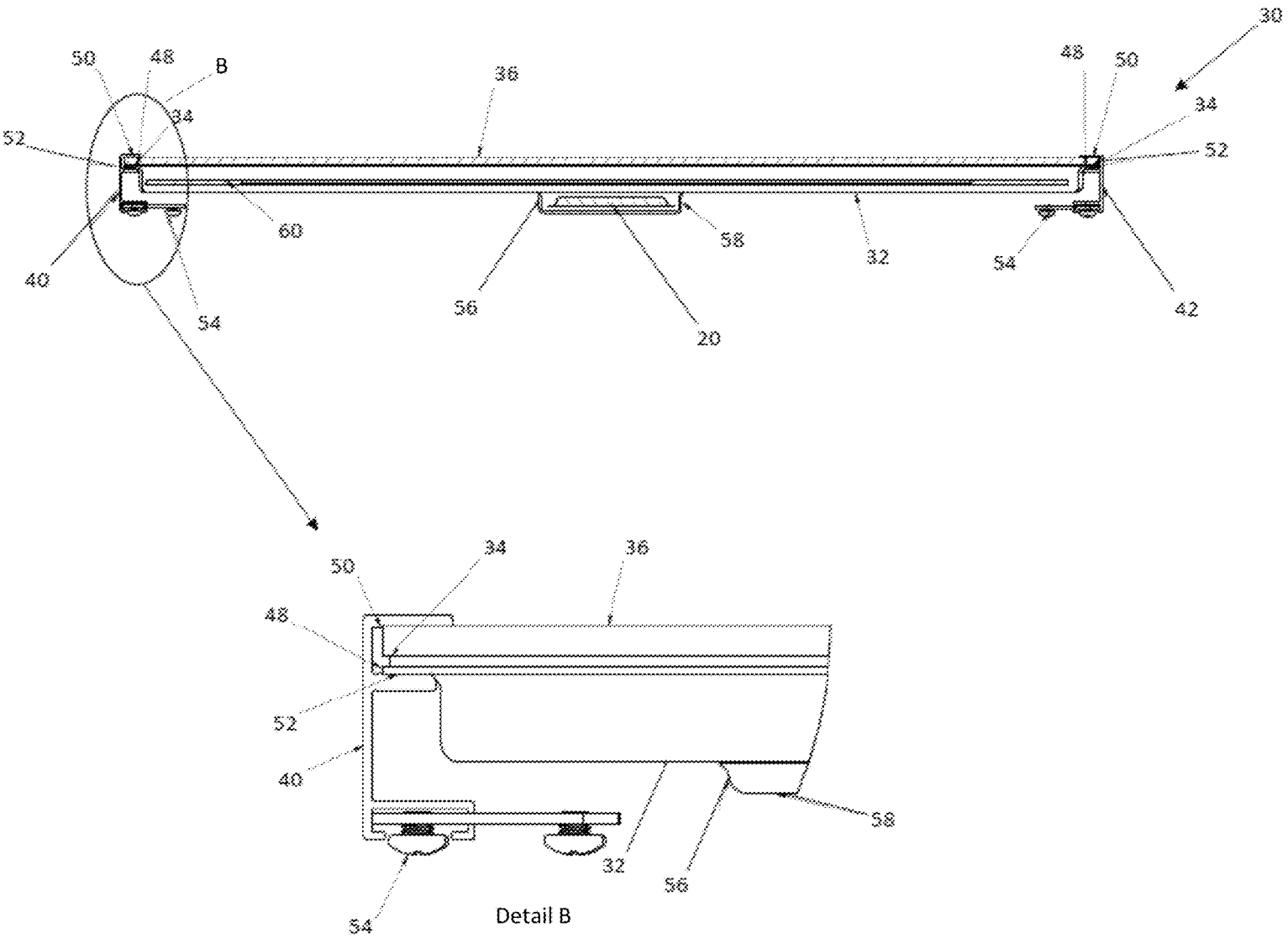
FIG. 2 is a cross-sectioned view of a microclimate hypoxic/anoxic framing enclosure with display item enclosed and with the cover and back plate or pan secured to the frame according to embodiments of the invention.

FIG. 2 is a cross-sectioned view of a microclimate hypoxic/anoxic framing enclosure 30 with display item 60 enclosed and with the cover 36 and back plate or pan 32 secured to the frame members (40, 42). An absorbent sachet 20 is shown placed in a compartment 58 behind or under the displayed item 30. Input ports 56 in the compartment 58 may be used to supply gases and power/data cables. As best seen in the close up (Detail B) frame member 40 has a radius lip 52 that supports the flange 48 of the back plate or pan 32. A gasket 34 is positioned above the flange 48 and is seated between the cover glass 36 and the flange 48 of the back plate or pan 32. The top lip 50 of the frame member 40 retains the cover 36 and the gap between the top lip 50 and the radius lip 52 is sized so as to provide a force fit that is airtight between the cover 36, gasket 34, and perimeter flange 48 of the of the back plate or pan 32. Frame joining hardware is shown as bolts 54, however it should be appreciated that other fasteners, joining devices, and methods may be used to join the frame members (40, 42, 44, 46) including press fits, rivets, adhesives, and wires. Examples of fasteners may illustratively include tapered machine screws, or the holes in the frame members may be pre drilled, tapped, and grooved to accept common fasteners such as recessed #6 or #8 button head screws.

Figure 3:
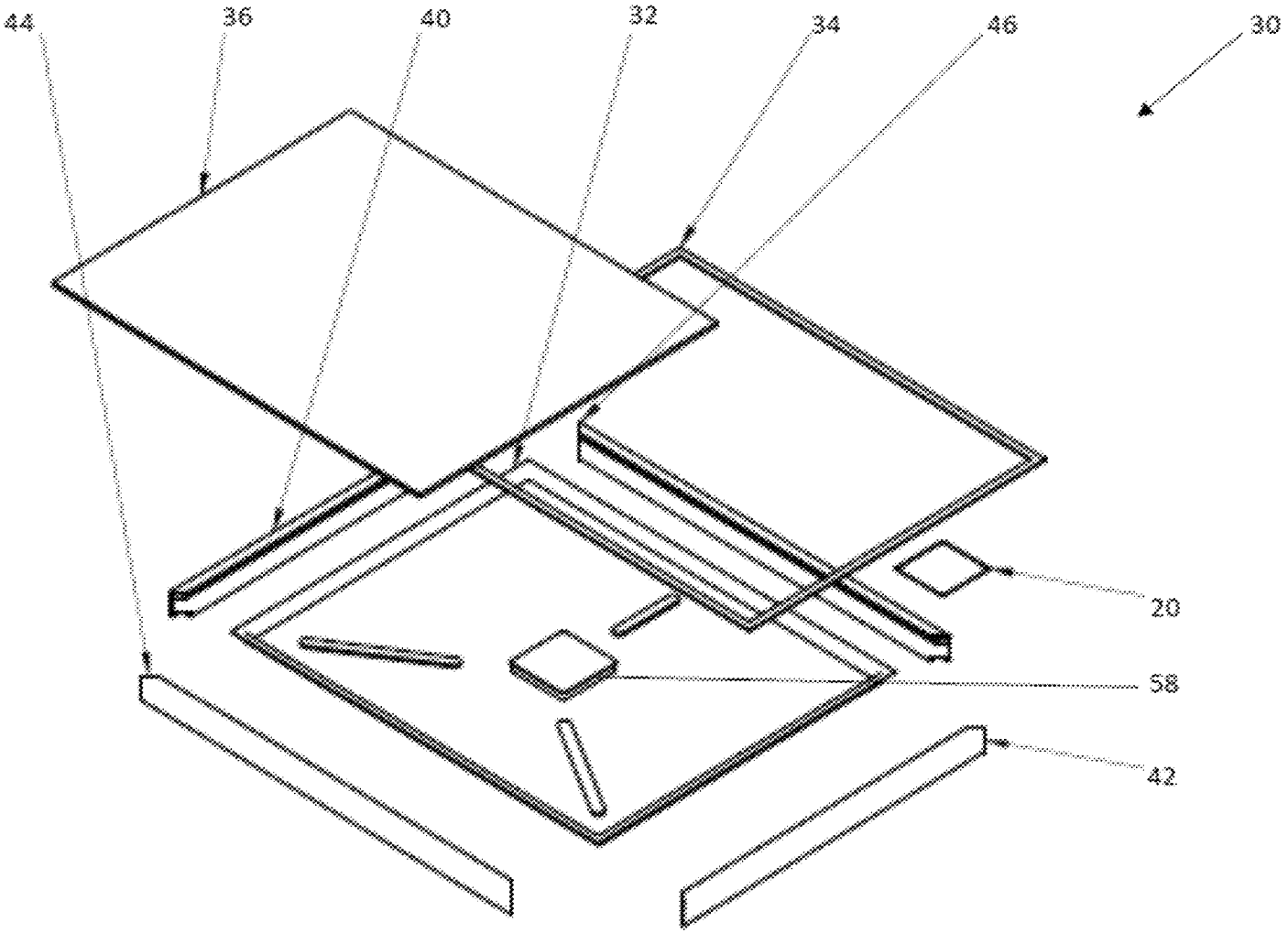
FIG. 3 is an exploded perspective drawing of the hypoxic/anoxic framing enclosure of FIG. 2 showing the back plate or pan, glazing, and frame according to embodiments of the invention.

FIG. 3 is an exploded perspective drawing of the hypoxic/anoxic framing enclosure 30 of FIG. 2 showing the back plate or pan 32, glazing (cover) 36, gasket 34, and frame members (40, 42, 44, 46) according to embodiments of the invention.

Figure 4:
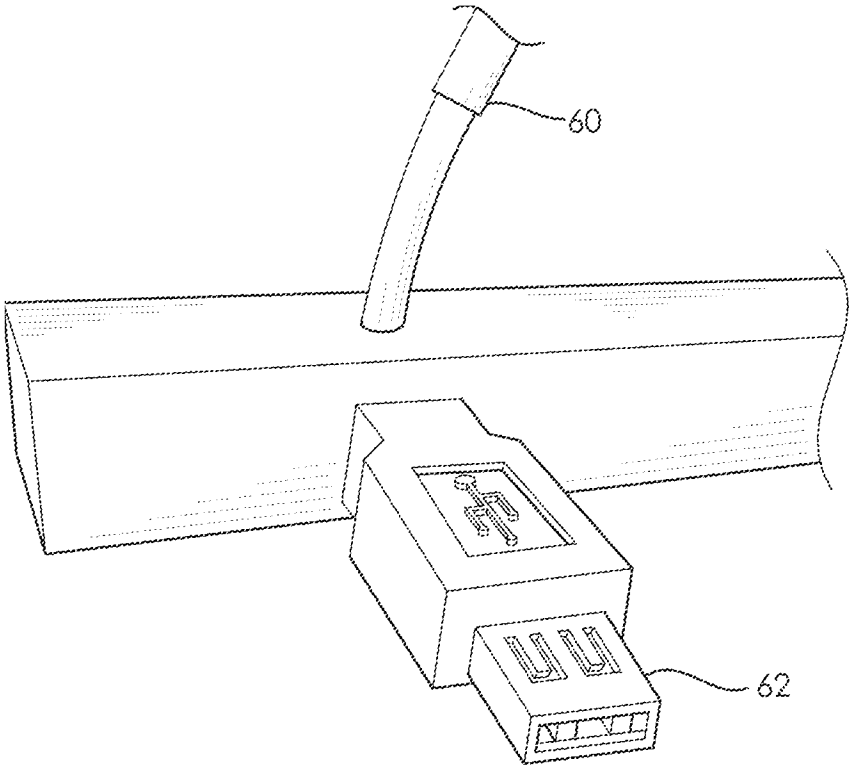
FIG. 4 shows a data line routed through an entry port with a universal serial bus (USB) termination for connection with a telemetry device within a sealed enclosure.

FIG. 4 shows an example of a power/data line 60 routed through an entry port with a universal serial bus (USB) termination 62 as an example of a user specified electrical connection for communication with a telemetry device and internal lighting within embodiments of the inventive sealed enclosure. Other conventional format cables are operative herein, these illustratively include DVI, HDMI, PS/2, Ethernet, VGA, 3.5 mm audio, USB-C, and display port. It is appreciated that in certain inventive embodiments, both one-way gas valves and data ports have insert points into the enclosure on the sides of the sides of the lower cavity (56, 58). A telemetry device measures various parameters such as humidity, barometric pressure, oxygen content, and other atmospheric components within an enclosure. A computing device may be connected to the telemetry device to record the measurement parameters, as well as to assist in the establishment of a required atmosphere within the enclosure. The connection or connections being a wired or wireless connection.

A method of testing and servicing an inventive enclosure is also described herein that involves the on display testing. Based on sensor data received from the telemetry device about the conditions within an inventive enclosure, damage to the enclosure is identified prior to catastrophic failure. When signals are sent to the computing device, an algorithm is used to create a warning that conditions within an enclosure are degrading. This warning can be in the form of an auditory alarm, or an electronic message that identifies the condition and identity of the enclosure, and in some instances a likely cause. A technician is dispatched to examine the compromised enclosure and accomplish field repairs if possible, else arrange for shipment to a refurbishment facility. Rather than leaving enclosures in place until a failure occurs, a program is also provided in which refurbished enclosures are rotated on a routine basis such as for example every year, 2 years, 3 years, or more years with incoming enclosures being subjected to at least one test of: leak testing, having gaskets repaired, corrosion testing, glass light transmissivity checked, sensor calibration, or a combination thereof.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The foregoing description is illustrative of particular embodiments of the invention, but is not meant to be a limitation upon the practice thereof. The following claims, including all equivalents thereof, are intended to define the scope of the invention.

The invention claimed is:

1. A controlled atmospheric enclosure comprising:

a frame with an upper lip and a lower lip formed as a single piece;

a gasket;

an injection molded, thermoformed, or stamped back plate or pan;

a cover that rests under said upper lip of said frame and said back plate or pan is supported by said lower lip of said frame, and where said gasket is positioned between said cover and said back plate or pan and forms a press fit between the upper lip and lower lip that is airtight and forms a controlled atmospheric enclosed area for display of objects and artifacts; one or more valves transiting from an outer side surface of said frame to said atmospheric enclosed area, the one or more valves configured for both inlet and exhaust with double seals; and wherein said atmospheric enclosed area further comprises inert gases inputted into said atmospheric enclosed are via said on or more valves.

2. The enclosure of claim 1 wherein said cover is a glazing.

3. The enclosure of claim 2 wherein said glazing is laminated glass.

4. The enclosure of claim 2 further comprising a coating on said glazing, said coating being anti-reflective and 98% UV filtering of standard green.

5. The enclosure of claim 2 wherein said glazing is one of water white glass or single strength coated glass.

6. The enclosure of claim 2 wherein said glazing has been annealed or tempered.

7. The enclosure of claim 2 wherein said glazing is electrochromic glass configured for variable control of light entering the enclosure.

8. The enclosure of claim 7 wherein shading of said electrochromic glass may be controlled electronically via a user interface, or the shading may change automatically based on the lighting conditions incident to said cover.

9. The enclosure of claim 1 wherein said back plate or pan is a multi-depth pan and said gasket is a formed-in-place gasket.

10. The enclosure of claim 1 wherein said frame and said back plate or pan are made of low cost and lightweight non-porous materials including coated sheet metal, ceramic, or glass.

11. The enclosure of claim 1 wherein said frame, said gasket, and said back plate or pan is secured with a wedge action of said frame, and where said frame forms a surrounding metal picture frame formed of extrusion molding.

12. The enclosure claim 1 wherein the controlled atmospheric enclosed area has an internal pressure that is positive to reduce contamination and inward leakage of the ambient air.

13. The enclosure of claim 1 wherein said frame is configurable for display of two dimensional (2-D) or three dimensional (3-D) artifacts.

14. The enclosure of claim 1 wherein said frame is configured for wall hanging or table top display.

15. The enclosure of claim 1 wherein within said airtight controlled atmospheric enclosed area there is a separate space for environmental materials for atmospheric controls, as well as test/indicator strips, data logging sensors, and an expandable bag for barometric control.

16. The enclosure of claim 15 wherein said environmental materials further comprise at least one of: zeolites, activated carbon, oxygen absorbers, or desicant-moisture absorbers.

17. The enclosure of claim 1 further comprising a power/data cable transiting from an outer side surface of said frame to said atmospheric enclosed area for connection to a telemetry device or internal lighting.

* * * * *